US006676111B2

(12) United States Patent
Bigham

(10) Patent No.: US 6,676,111 B2
(45) Date of Patent: Jan. 13, 2004

(54) UNIVERSAL MANHOLE COVER ENGAGING TOOL

(76) Inventor: Vern Bigham, 354 Forest La., Mankato, MN (US) 56003

( * ) Notice: Subject to any disclaimer, the term of this patent is extended or adjusted under 35 U.S.C. 154(b) by 4 days.

(21) Appl. No.: 10/142,554

(22) Filed: May 9, 2002

(65) Prior Publication Data

US 2003/0085390 A1 May 8, 2003

Related U.S. Application Data

(63) Continuation-in-part of application No. 10/012,897, filed on Nov. 5, 2001.

(51) Int. Cl.[7] ..... B66F 3/00

(52) U.S. Cl. ..... 254/131; 414/684.3; 294/17

(58) Field of Search ..... 254/131, 120, 254/8 R; 294/17, 18, 15; 296/17; 414/689.3, 444, 494; 280/47.27

(56) References Cited

U.S. PATENT DOCUMENTS

| | | | | | |
|---|---|---|---|---|---|
| 1,427,576 | A | | 8/1922 | Bryant | |
| 3,275,299 | A | * | 9/1966 | Meshew | 254/131 |
| 3,985,338 | A | | 10/1976 | Herrmann | |
| 4,157,810 | A | | 6/1979 | Haller et al. | |
| 4,365,786 | A | | 12/1982 | Osteen | |
| 4,365,925 | A | * | 12/1982 | Girtz | 414/684.3 |
| 4,488,706 | A | * | 12/1984 | Kono | 254/131 |
| 4,612,730 | A | | 9/1986 | Gundy | |
| 4,621,941 | A | | 11/1986 | Ditcher et al. | |
| 4,662,607 | A | * | 5/1987 | Mochizuki et al. | 254/131 |
| 4,695,037 | A | | 9/1987 | Hadbavny | |
| 4,793,646 | A | | 12/1988 | Michaud, Jr. | |
| 4,826,388 | A | * | 5/1989 | Golding | 414/684.03 |
| 4,838,521 | A | * | 6/1989 | Moisan | 254/131 |
| 4,991,893 | A | | 2/1991 | Gordon et al. | |
| 5,165,661 | A | | 11/1992 | Wright | |
| 5,292,107 | A | * | 3/1994 | Chick | 254/131 |
| 5,431,459 | A | | 7/1995 | Gundy | |
| 5,462,385 | A | | 10/1995 | Mohlengraft | |
| 5,531,541 | A | | 7/1996 | Clover et al. | |
| 5,674,045 | A | | 10/1997 | Eckloff et al. | |
| 5,775,674 | A | | 7/1998 | Bigham | |
| 5,865,425 | A | | 2/1999 | Meadows | |
| 5,947,633 | A | | 9/1999 | Foss | |
| 6,176,469 | B1 | | 1/2001 | Bigham | |
| 6,520,482 | B1 | * | 2/2003 | Bigham | 254/131 |

* cited by examiner

*Primary Examiner*—George Nguyen
*Assistant Examiner*—Daniel G. Shanley
(74) *Attorney, Agent, or Firm*—Westman, Champlin & Kelly, P.A.

(57) ABSTRACT

A portable apparatus for displacing a manhole cover from a manhole where the manhole cover includes an engaging surface. The portable apparatus includes a leg having a first end and a second end and a shaft attached to the first end of the leg such that the leg and the shaft define a fulcrum point for the device. A tool is pivotally attached to the leg wherein the tool engages the engaging surface of the manhole cover.

9 Claims, 4 Drawing Sheets

UNIVERSAL MANHOLE COVER ENGAGING TOOL

CROSS-REFERENCE TO RELATED APPLICATION(S)

This is a continuation-in-part of U.S. application Ser. No. 10/012,897, filed Nov. 5, 2001.

BACKGROUND OF THE INVENTION

The present invention relates to a tool for lifting a manhole cover. More particularly, the present invention relates to a portable manually operated manhole cover engaging tool.

Utility covers, also known as "manhole" covers, are frequently used to cap entrances to subsurface enclosures. For example, manhole covers are often used to cover the openings to sanitary and storm sewers, subsurface telephone cable and communication line junction boxes, electrical enclosures, and enclosures providing access to subterranean pipes.

Most manhole covers are constructed of thick metal, commonly steel, and are often very heavy usually weighing over 50 pounds. The great strength and weight of manhole covers serve a number of purposes, including preventing unauthorized access to the enclosure by children or other persons, preventing inadvertent movement and displacement of the manhole cover by vehicles, and providing a solid base for people and transportation equipment traveling over the manhole.

However, the weight of manhole covers also poses a significant problem to their use because they are difficult and sometimes hazardous to remove. The fact that manhole covers are usually heavy, combined with the fact that they are usually positioned at ground level, means that a worker trying to remove a manhole cover usually attempts to lift the heavy manhole cover from a bent-over position. This bent-over lifting position can lead to back injuries, which result in pain and suffering. These injuries also cause lost productivity and income for employees and employers.

A conventional method of removing manhole covers is to pry the edge of the manhole cover upward with a pick, and then rotate the cover away from the opening with either the pick or another tool, such as a shovel or pry-bar. Conventional removal methods often require that the worker removing the cover grab the edge of the cover. Grabbing a manhole cover can be very hazardous, because workers risk crushing their fingers under the weight of the cover or severely pinching their fingers between the cover and the rim of the manhole. Also, use of the hands usually means that the worker is bent over the manhole, providing additional concern about back injury.

Conventional apparatuses and methods of opening manholes also pose the problem that the worker must be relatively close to the manhole while removing the cover. The proximity of the worker to the manhole can be problematic because manholes are often very deep, and falling into an open manhole can cause severe injuries or even death. Under some circumstances, such as overflowing sewers or ruptured water mains, water may be leaking out of the top of the manhole, creating a slippery, wet surface proximate the manhole opening. This slippery surface can be especially troubling during winter when ice forms proximate the manhole. Therefore, it is desirable for a manhole opener to permit the removal of the manhole cover while the worker is a safe distance from the opening.

A further problem associated with removing manhole covers is that not all manhole covers can be removed in the same manner. In many towns the local foundry makes the manhole covers resulting in a wide variation in the design of the manhole covers. Some covers have a small round opening in the middle of the cover. Other manhole covers have a slot or depression on the outer edge of the cover, while still others have one or more slots, holes, or depressions positioned between the edge and the center of the manhole cover. These various configurations can be a challenge to open, and may require specialized tools for each manhole cover.

Another problem associated with removing manhole covers is the difficulty in replacing the manhole cover. A conventional method is to use a pick to pry up the edge of the cover, which is then manually flipped up onto its side, rolled over to the opening, and then slowly rotated into place. This is a tedious and somewhat difficult task because of the great weight of the cover. Also, two people are often required to easily replace the manhole cover, the first to pry the edge off the ground, and the second to flip the manhole cover into a vertical position and roll it into place.

Accordingly, there is a need for an apparatus and method for safely, easily, and efficiently removing and replacing a manhole cover. Even further, there is a need for an apparatus which permits one person to remove and replace a manhole cover with a minimum of stress and danger, and a reduced risk of injuries to hands, feet, and backs.

BRIEF SUMMARY OF THE INVENTION

The present invention includes a portable apparatus for removing a manhole cover from a manhole where the manhole cover includes an engaging surface. The portable apparatus includes a leg having a first end and a second end and a shaft attached to the first end of the leg such that the leg and the shaft define a fulcrum point. A tool is pivotally attached to the second end of the leg wherein the tool engages the engaging surface of the manhole cover thereby allowing the manhole cover to be lifted.

DETAILED DESCRIPTION

Figure 1:
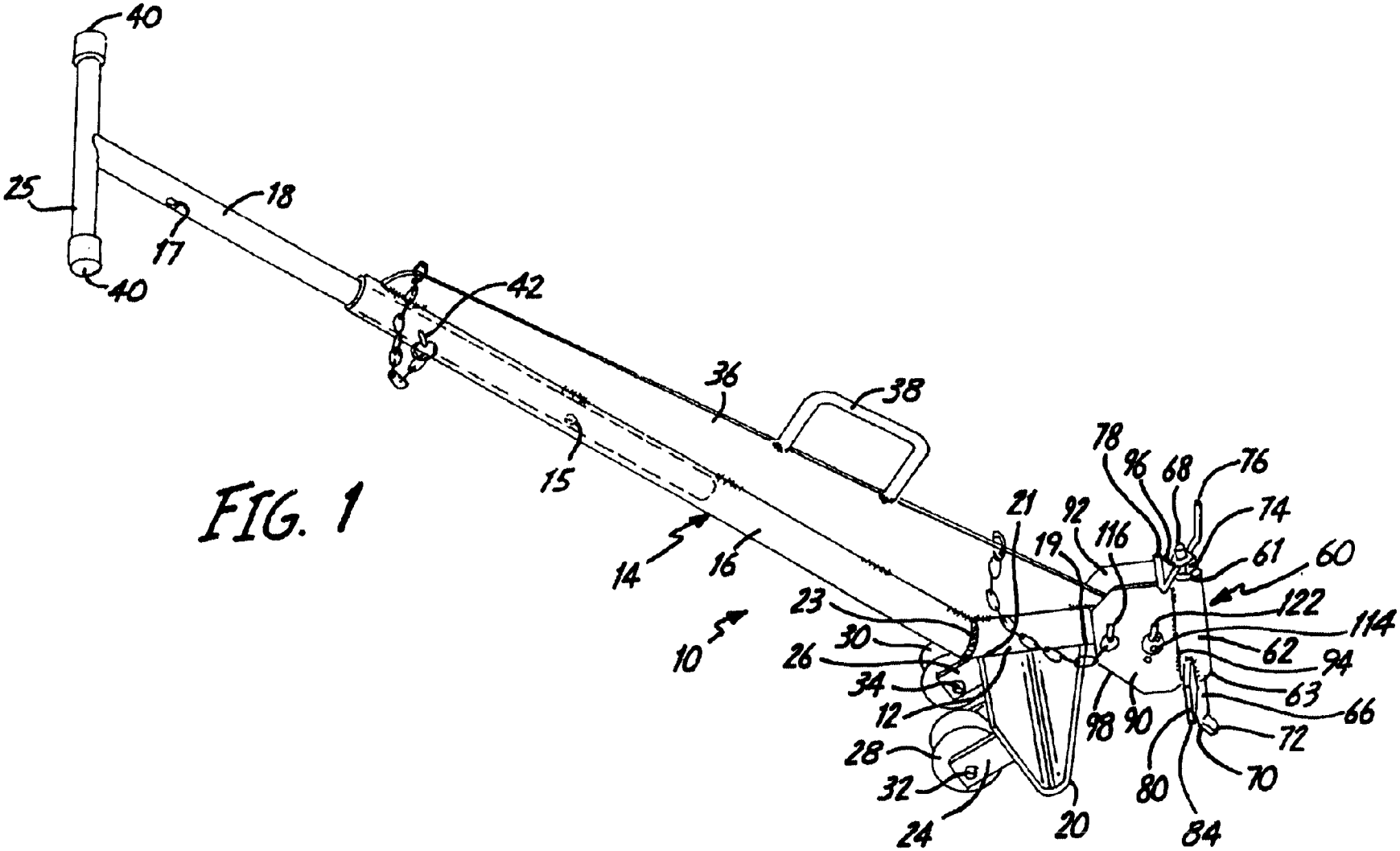
FIG. 1 is a perspective view of the lifting apparatus of the present invention having a manhole cover engaging tool attached thereto.

A portable manhole cover lifting apparatus of the present invention is illustrated in FIG. 1 generally at 10. The manhole cover lifting apparatus 10 includes a leg 12 attached to a shaft 14 wherein the shaft 14 and the leg 12 create an obtuse angle.

Figure 2:
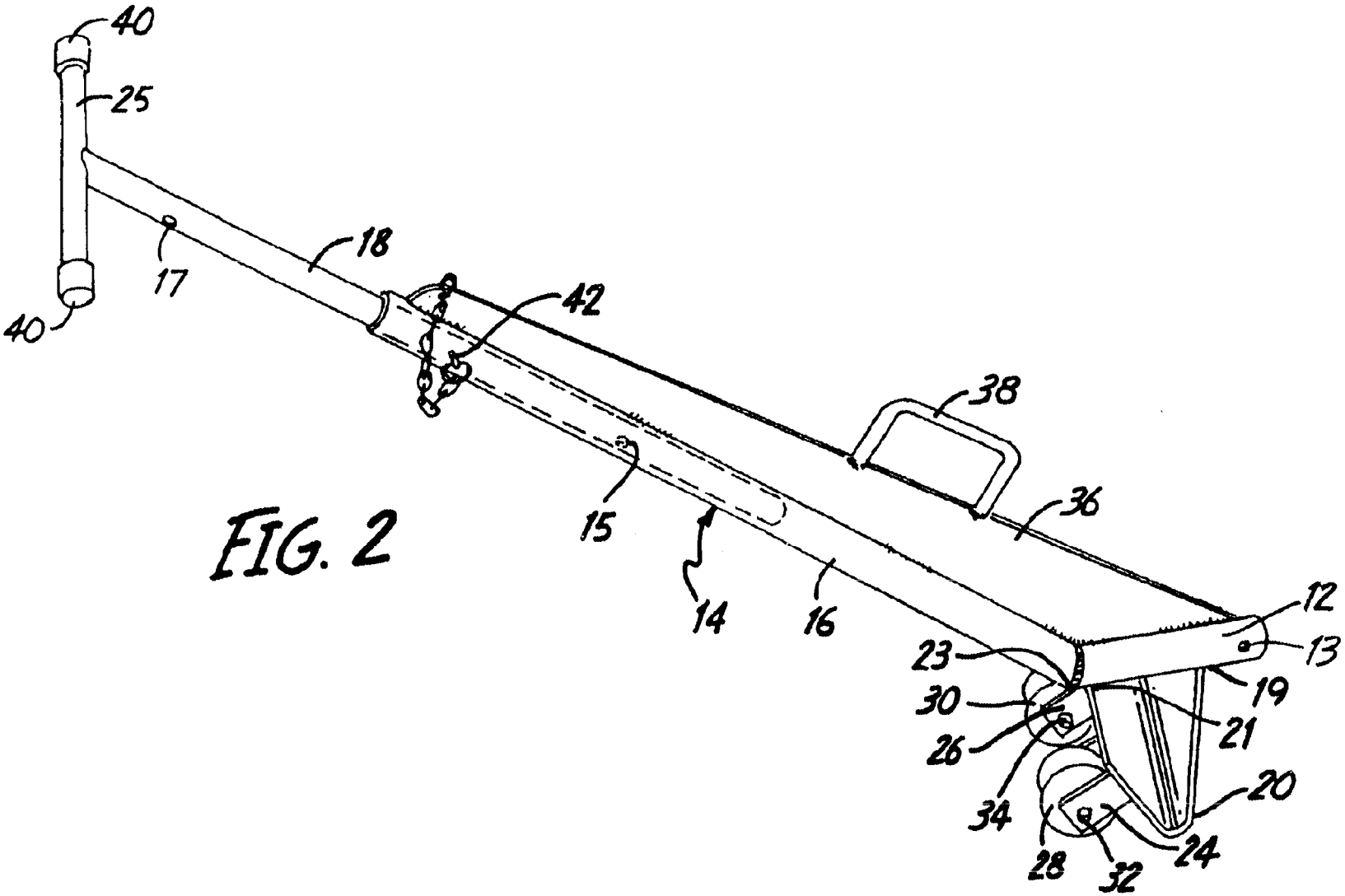
FIG. 2 is a perspective view of the handle portion of the lifting apparatus of the present invention.

Referring to FIGS. 1 and 2, the leg 12 preferably has a circular cross-section, although other cross-sectional geometries are within the scope of the present invention. The leg 12 is preferably a pipe having a circular cross sectional cavity defined by a wall. A set of aligned apertures 13 (with only one being shown) are located at a distal end 11 of the leg 12 as best illustrated in FIG. 2.

Referring to FIGS. 1 and 2, a surface engaging member 20 is attached to the leg 12 proximate a pivot point or fulcrum point 23 defined by the attachment of the shaft 14 to the leg 12. The surface engaging member 20 preferably has an arcuate shape wherein a first end 19 and a second end 21 are attached to a bottom portion of the leg 12.

The lifting apparatus 10 is preferably made of aluminum to minimize the weight of the lifting apparatus 10 although other materials of construction are within the scope of the present invention. Aluminum provides the required strength to lift and maneuver a manhole cover (not shown) while being substantially lighter than steel. In the preferred embodiment, the lifting apparatus 10 weighs approximately eight (8) pounds.

Because the surface engaging member 20 is preferably made of aluminum, the aluminum has a tendency to erode with use. In order to minimize the erosion of the aluminum from the surface engaging member 20, a steel plate (not shown) is attached to the engaging surface of the surface engaging member 20, preferably by a plurality of bolts (not shown) although other attaching mechanisms are within the scope of the invention.

A first and second set of tabs 24, 26 respectively, are attached to the arcuate surface engaging member 20 proximate the second end 21. The first and second set of tabs 24, 26 each have a set aligned apertures (not shown). Preferably a tandem set of wheels 28, 30 are disposed between each set of tabs 24, 26, respectively. A bolt 32, 34 is disposed through the aligned apertures (not shown) in each set of tabs 24, 26 and the tandem set of wheels 28, 30, respectively, and is secured in a selected position with a nut (not shown). The bolt 32, 34 is an axle for the tandem set of wheels 28, 30 such that the tandem set of wheels 28, 30 rotate about the bolt 32, 24, respectively.

A fillet 36 is attached to both the leg 12 and the shaft 14 along the point of attachment of the leg 12 to the shaft 14 where the fillet 36 conforms to the obtuse angle. The fillet 36 provides strength and structural integrity to the lifting apparatus 10. A second handle 38 is attached to an outer edge of the fillet 36. Because the lifting apparatus 10 of the preferred embodiment weighs about eight (8) pounds, the second handle 38 allows the operator of the lifting apparatus 10 to easily carry the apparatus 10 from location-to-location.

A first handle 25 is attached to a second end of the shaft 14 in a substantially perpendicular configuration. The shaft 14 is centrally located on the first handle 25 and the first handle 25 is in a substantially orthogonal relationship with the leg 14. Preferably, rubber or plastic coverings 40 are disposed over each end of the first handle 25 to provide protection to the user of the apparatus.

Preferably, the shaft 14 includes a lower section 16 and an upper section 18. The upper section 18 telescopes within a through bore in the lower section 16 such that a length of the shaft 14 is adjustable. The telescoping feature of the shaft 14 is especially useful in shortening the length of the apparatus 10 for transporting and storing the apparatus 10.

Figure 4:
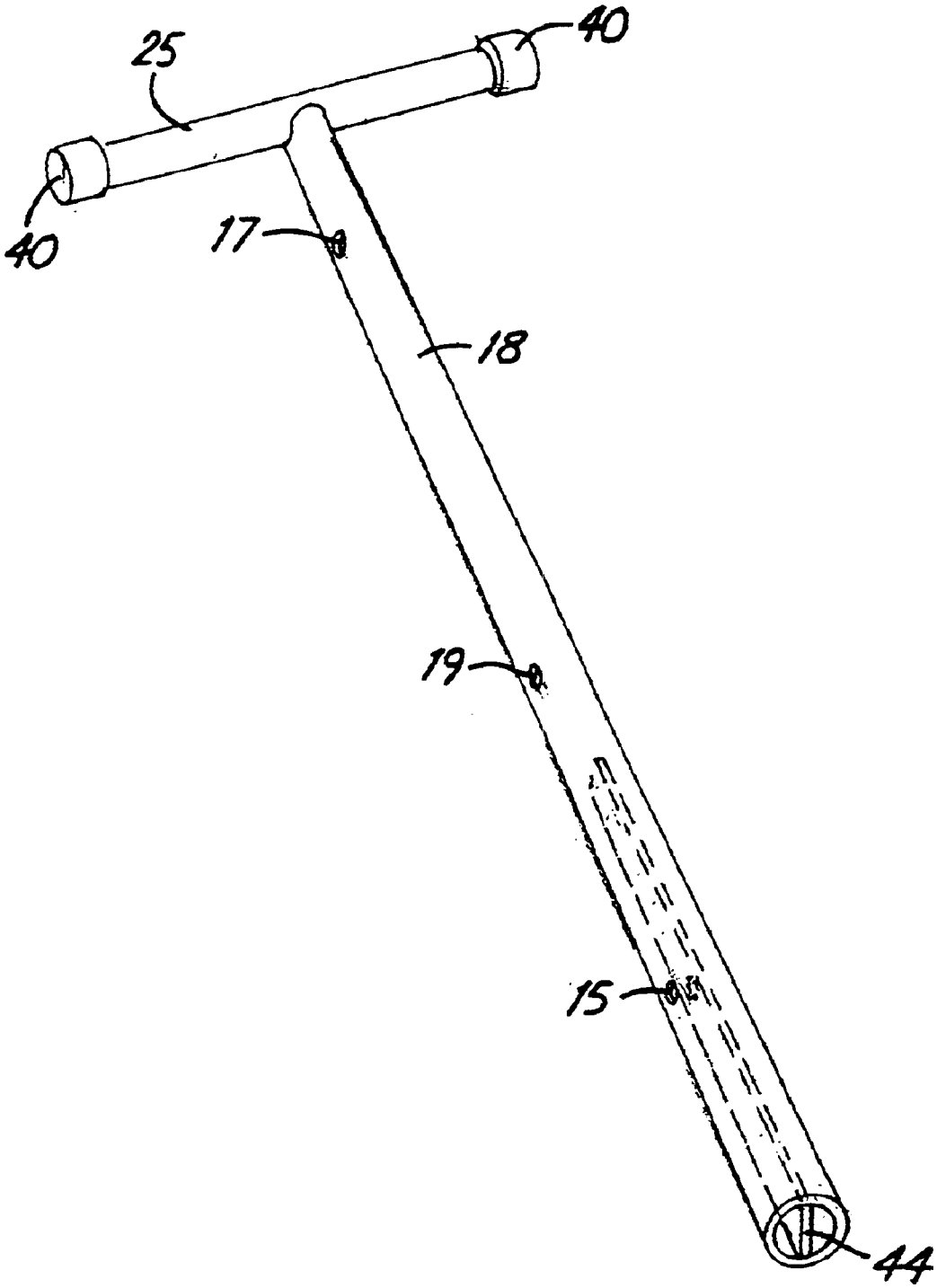
FIG. 4 is a perspective view of the upper portion of the telescoping handle of the present invention.

Referring to FIGS. 1, 2, and 4, the upper portion 18 of the shaft preferably has three sets of aligned apertures 15, 17, 19 along a horizontal axis of the portion. A first set of aligned apertures 15 is disposed proximate a distal end, a second set of aligned apertures 19 are disposed proximate a proximal end and a third set of aligned apertures 17 are disposed between the first and second set of aligned apertures 15, 19, respectively, proximate a mid-point of the upper portion. To secure the upper portion 18 in a selected position, one of the three sets of apertures in the upper portion 18 are aligned with a set of aligned apertures 13 in the lower portion and a pin 42 is inserted therethrough.

Referring to FIG. 4, a rib 44 is preferably disposed along a lower length of the upper portion 18 within an interior opening and along a vertical axis. The rib 44 is in an orthogonal relationship with the first set of apertures 15. The rib 44 includes an aperture to provide an opening through the upper portion at first apertures 15. Although a telescoping shaft 12 is preferred, one skilled in the art will appreciate that a shaft 12 of a fixed length is also within the scope of the invention.

Figure 3:
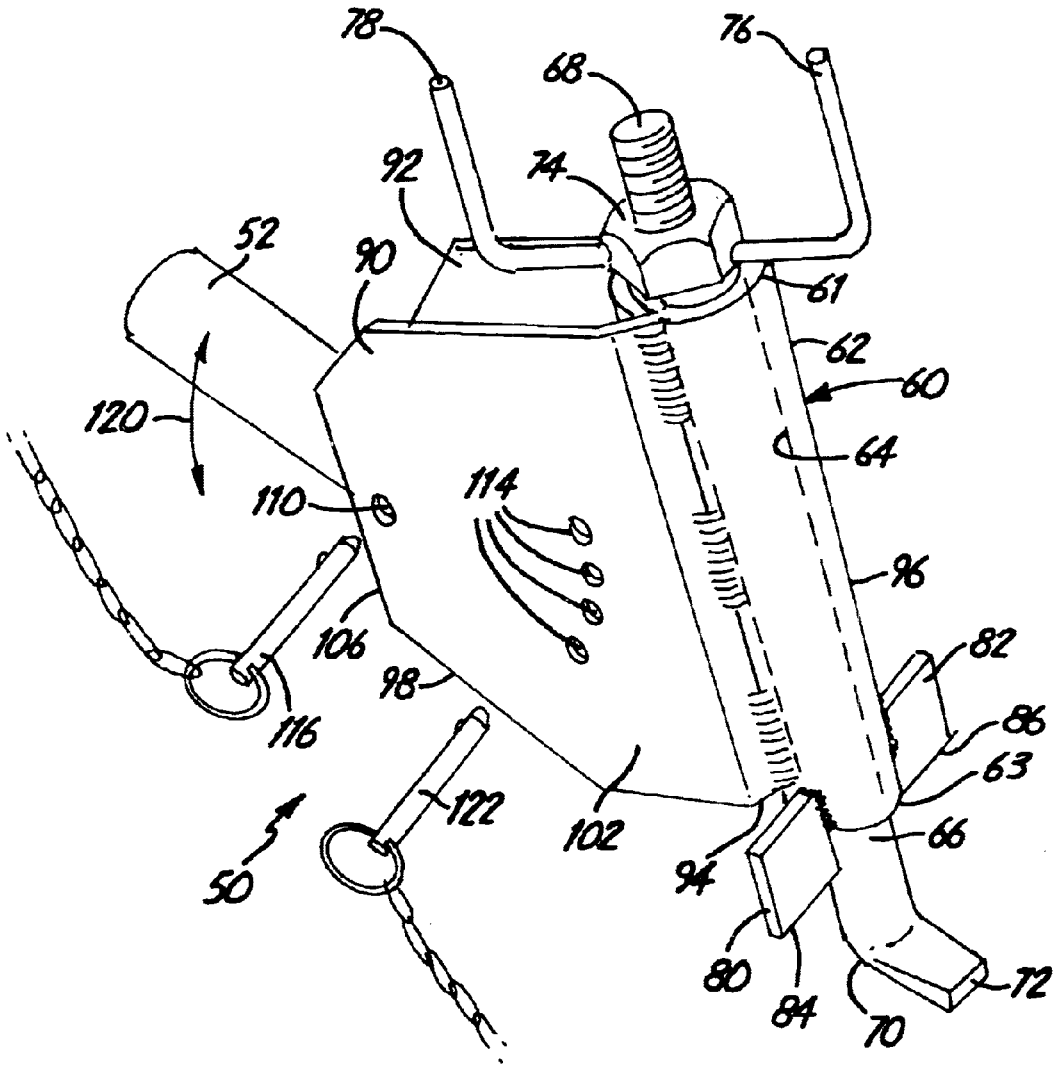
FIG. 3 is a perspective view of the manhole cover engaging tool of the present invention.

Referring to FIGS. 1 and 3, a universal manhole cover engaging tool 50 is attached to the distal end of the leg 12. Referring to FIG. 3, the universal manhole cover engaging tool 50 includes a stump shaft 52 and a manhole cover engaging portion 60. The stump shaft 52 operably connects the leg 12 to the manhole cover engaging portion 60. One skilled in the art will recognize that although a stump shaft 52 is in the preferred embodiment, the stump shaft 52 is not required to practice the invention. One skilled in the art will recognize that extending the length of the leg 12 performs the same function as inserting the stump shaft 52 into the leg 12.

The manhole cover engaging portion 60 includes a pipe 62 have a through hole 64 defined by a pipe wall. A shaft 66 is disposed through the through hole 64 such that a threaded first end 68 extends beyond a first end 61 of the pipe 62. A second end 70 of the shaft 66 extends beyond a second end 63 of the pipe 62. The shaft 66 has a portion 72 extending from the second end 70 such that the second end 70 has an arcuate configuration.

A nut 74 threadably engages the threaded first end 68 of the shaft 66 to adjust the distance between the arcuate second end 70 of the shaft 66 and the second end 63 of the pipe 62. First and second "L" shaped members 76, 78 are disposed on opposite sides of the nut 74 to provide the user of the tool 50 leverage such that a wrench is not required to rotate the nut.

First and second wings 80, 82 are attached to the pipe 62 at the second end 63. The first and second wings 80, 82 are disposed on opposite sides of the pipe 62 and extend beyond the second end 63 of the pipe 62. Bottom surfaces 84, 86 of the first and second wings 80, 82, respectively, engage an upper surface of the manhole cover (not shown) when the portion 60 is secured to the manhole cover (not shown).

Extending from the pipe 62 are first and second side walls 90, 92 which are spaced apart a selected distance. A first end 94, 96 of each of the first and second side walls 90, 92, respectively, are preferably welded to the pipe 62 such that the first and second side walls 90, 92 and the first and second wings 80, 82 are in an orthogonal relationship.

The first and second side walls 90, 92 have angled surfaces 98 (not shown) connecting a bottom surface 102 (not shown) and a second end 106 (not shown), all respectively. The angled surfaces 98 (not shown) provide clearance when the universal manhole cover engaging tool 50 engages a manhole cover (not shown).

The first and second side walls 90, 92 include a first set of aligned apertures 110 proximate the second end 106 (not shown), respectively. The first and second side walls 90, 92 also include a series of sets of aligned apertures 114 wherein the series of sets of aligned apertures 114 are a same radial distance from the first set of aligned 110 apertures proximate the second end 106 (not shown), respectively.

The manhole cover engaging tool 10 is assembled by disposing the stub shaft 52 within a cavity in the leg 12 and aligning the set of aligned apertures 13 at the distal end of the leg 12 with apertures (not shown) proximate the middle portion of the stub shaft 52. The distal end of the leg 12 is disposed between the first and second side walls 90, 92 and the set of aligned apertures 13 proximate the distal end of the leg 14 are aligned with the set of aligned apertures 110 proximate the second ends 106 (not shown) of the first and second side walls 90, 92, respectively. A pin 116 is inserted through the set of aligned apertures 110 in the first and second side walls 90, 92, the set of aligned apertures 13 in the leg 12, and the set of aligned apertures (not shown) in the stub shaft 52 to pivotally attach the universal manhole cover engaging tool 50 to the leg 12.

The position of the universal manhole cover engaging portion 60 is adjusted by pivoting the portion 60 about the pin 116. In the preferred embodiment, a series of four sets of apertures 114 are the selected radial distance from the set of aligned apertures 110 proximate the second ends 106 (not shown) of the first and second side walls 90, 92, respectively. One skilled in the art will recognize that the series of sets of apertures allow the angle of the portion 60 to be adjusted as illustrated by arrows 120 to better engage the manhole cover (not shown). Once the portion 60 is at the selected angle, a pin 122 is inserted through a set of the series of aligned apertures 114 which are aligned with a set of apertures (not shown) proximate the distal end of the stub shaft 52 to retain the universal manhole cover engaging portion 60 in the selected position.

In operation, the lifting apparatus 10 is positioned proximate a manhole cover (not shown). The arcuate second end 70 of the shaft 66 of the manhole cover engaging portion 60 is either disposed into a slot or through a through hole in the manhole cover (not shown). The arcuate second end 70 is designed to engage either style of manhole cover (not shown) whether the manhole cover (not shown) has slots or through holes.

Addressing a manhole cover (not shown) with a through hole first, the arcuate second end 72 of the shaft 66 is disposed through the through hole. The nut 74 is rotated to raise the second arcuate end 72 into contact with a bottom surface of the manhole cover (not shown). The nut 74 is further rotated to provide a frictional engagement of the bottom surfaces 84, 86 of the first and second wings 80, 82, respectively, with the top surface of the manhole cover (not shown) and the arcuate second end 70 with the bottom surface of the manhole cover (not shown). With the universal manhole cover engaging portion 60 secured to the manhole cover (not shown), the angle of the portion 60 is fixed in a selected position by aligning one set of the series of sets of aligned apertures 114 with the set of aligned apertures (not shown) in the stub shaft 52 and disposing the pin 122 therethrough.

With the universal manhole cover engaging tool 50 secured in the selected position, a downward force is applied to the first handle 25 which in turn applies an upward force on the universal manhole cover engaging portion 60. The upward force applied by the portion 60 to the manhole cover (not shown) is proportionally greater than the downward force applied to the first handle 25 by the ratio of the length of the handle 14 to the distance of the portion 60 from the fulcrum point. The force applied on the manhole cover (not shown) by the lifting apparatus 10 disengages the manhole cover (not shown) from the manhole (not shown). The first handle 25 is pivoted downward on the arcuate surface engaging member 20 until the first and second set of tandem wheels 28, 30 engage the surface (not shown) proximate the manhole cover (not shown) and the surface engaging member 20 is displaced from the surface (not shown).

With the manhole cover (not shown) displaced from the manhole (not shown) and the first and second sets of tandem wheels 28, 30 contacting the surface proximate the manhole (not shown), the user can wheel the manhole cover (not shown) away from the manhole (not shown). Once the manhole cover (not shown) is in a desired position, the manhole cover (not shown) is lowered. As the manhole cover (not shown) is lowered, the surface engaging member 20 contacts the surface and displaces the first and second sets of tandem wheels 28, 30 therefrom. The device 10 is further rotated on the surface engaging member 20 until the manhole cover (not shown) is resting on the surface (not shown). With the manhole cover (not shown) resting on the surface (not shown), the portion 60 is disengaged from the manhole cover such that the lifting apparatus 10 is able to be used to remove another manhole cover if desired.

Once the work in the manhole (not shown) has been completed, the lifting apparatus 10 is positioned proximate the manhole cover (not shown) and the universal manhole cover engaging portion 60 is reengaged with the manhole cover (not shown) through the aperture. A downward force is applied to the first handle 25 thereby applying the proportionally greater force to the manhole cover (not shown) which lifts the manhole cover. The downward force is further applied to the first handle 25 until the first and second sets of tandem wheels 28, 30 engage the surface allowing the user to wheel the manhole cover (not shown) into position over the manhole (not shown). The manhole cover (not shown) is lowered into the manhole (not shown) until the manhole cover (not shown) rests within the manhole (not shown) at which time, the universal manhole cover engaging portion 60 is disengaged from the aperture in the manhole cover (not shown).

The universal manhole cover engaging portion 60 also engages a manhole cover (not shown) having a slot by inserting the arcuate second end 70 of the shaft 66 within the slot. With the arcuate second end 70 within the slot, the nut 74 is rotated upon the shaft 66 thereby decreasing the distance between the bottom surfaces 84, 86 of the first and second wings 80, 82 and the arcuate second end 70. As the nut 74 is rotated, the bottom surfaces 84, 86 of the first and second wings 80, 82 contact the upper surface of the manhole cover (not shown). Further manipulation of the nut 74 causes a frictional engagement between the arcuate second end 70 of the shaft 66, upper surface of the slot (not shown) and the bottom surfaces 84, 86 of the first and second wings 80, 82. With the portion 60 secured to the manhole cover (not shown), the angle of attachment of the tool 50 to the leg 12 is adjusted as indicated by arrows 120 and secured by inserting the pin 122 through one set of the series of apertures 114 and the apertures (not shown) in the stub shaft 52.

The manhole cover (not shown) is displaced from the manhole (not shown) and wheeled away from the manhole in the same manner as previously described. The manhole cover (not shown) is placed back into the manhole (not shown) by reattaching the portion 60 and using the mechanical advantage of the length of the shaft 14 in relation to the length of the leg 12.

The position of the bottom surface 84, 86 of the first and second wings 80, 82 being below the second end 63 of the pipe 62 allows slots of various depths to be engaged by the second arcuate end 70 of the shaft 66. Additionally, the first and second wings 80, 82 are positioned along a vertical plane with an axis of the shaft 66. Positioning the first and second wings 80, 82 along the vertical axis of the shaft 66 allows the portion 60 to engage the top surface of the manhole covers (not shown). The position of the first and second wings 80, 82 relative to the axis of the shaft 66 is important when attempting to lift manhole covers (not shown) having slots at the edge of the manhole cover. When the first and second wings 80, 82 are positioned behind the axis of the shaft 66, the wings 80, 82 may not engage the top surface of the manhole cover (not shown) and not securely engage the portion 60 with the manhole cover (not shown).

Although the present invention has been described with reference to preferred embodiments, workers skilled in the art will recognize that changes may be made in form and detail without departing from the spirit and scope of the invention.

What is claimed is:

1. A portable apparatus for removing a manhole cover from a manhole, the manhole cover having an engaging surface, the apparatus comprising:

a leg having a first end and a second end;

a shaft having a first end and a second end wherein a first end of the shaft is attached to the first end of the leg wherein the attachment of the first ends of the leg and the shaft define an obtuse angle and wherein the attachment of the leg and the shaft provide a fulcrum point for the device;

a tool pivotally attached to the second end of the leg wherein the tool engages the engaging surface; and a fillet attached to the leg and the shaft at the fulcrum point.

2. A portable apparatus for removing a manhole cover from a manhole, the manhole cover having an engaging surface, the apparatus comprising:

a leg having a first end and a second end;

a shaft having a first end and a second end wherein a first end of the shaft is attached to the first end of the leg wherein the attachment of the first ends of the leg and the shaft define an obtuse angle and wherein the attachment of the leg and the shaft provide a fulcrum point for the device;

a tool pivotally attached to the second end of the leg wherein the tool engages the engaging surface and wherein the tool comprises:

a member having a first end and a second end and wherein the member includes a through hole;

a shaft disposed through the through hole in the member, the shaft having a threaded first end extending beyond the first end of the member and a manhole cover engaging second end extending below the second end of the member; and a nut threadably engaged with the threaded first end of the shaft wherein the threadable engagement adjusts a position of the manhole cover engaging second end; and first and second side walls wherein first ends of the first and second side walls are attached to the member and extending therefrom wherein the first and second side wall include a first set of aligned apertures through the first and second side walls proximate a second end and a plurality of sets of aligned apertures a common radial distance from the first set of apertures proximate the first end.

3. The apparatus of claim 2 wherein the tool further comprises first and second wings attached to the second end of the member.

4. A tool for lifting a manhole cover, the tool comprising:

a shaft having a manhole cover engaging end portion comprising:

a member having a first end and a second end and wherein the member includes a through hole;

a shaft disposed through the through hole in the member, the shaft having a threaded first end extending beyond the first end of the member and a manhole cover engaging second end extending below the second end of the member; and a nut threadably engaged with the threaded first end of the shaft wherein the threadable engagement adjusts a position of the manhole cover engaging second end;

a ground engaging fulcrum portion attached to the shaft for pivoting the manhole cover engaging end portion to lift the manhole cover; and ground engaging wheels rotatably attached to the shaft for moving the manhole cover once the manhole cover is lifted.

5. The tool of claim 4 wherein the manhole cover engaging portion further comprises first and second side walls wherein first ends of the first and second side walls are attached to the member and extending therefrom wherein the first and second side wall include a first set of aligned apertures through the first and second side walls proximate a second end and a plurality of sets of aligned apertures a common radial distance from the first set of apertures proximate the first end.

6. The tool of claim 4 wherein the manhole cover engaging portion further comprises first and second wings attached to the second end of the member.

7. A tool for lifting a manhole cover, the tool comprising:

a shaft having a distal end portion;

a ground engaging fulcrum portion attached to the shaft for pivoting the distal end portion in a generally vertical direction; and a manhole cover engaging tool pivotally secured to the distal end portion for pivotally changing an angle of engagement with the manhole cover, wherein the manhole cover engaging tool comprises:

a member having a first end and a second end and wherein the member includes a through hole; and a shaft disposed through the through hole in the member, the shaft having an adjustable first end extending beyond the first end of the member and a manhole cover engaging second end extending below the second end of the member.

8. The tool of claim 7 wherein the manhole cover engaging tool further comprises first and second side walls wherein first ends of the first and second side walls are attached to the member and extending therefrom wherein the first and second side wall include a first set of aligned apertures through the first and second side walls proximate a second end and a plurality of sets of aligned apertures a common radial distance from the first set of apertures proximate the first end.

9. The tool of claim 8 wherein the manhole cover engaging portion further comprises first and second wings attached to the second end of the member, the first and second wings being in an orthogonal relationship with the first and second side walls.

* * * * *